US006618929B2

(12) United States Patent
Kitamura

(10) Patent No.: US 6,618,929 B2
(45) Date of Patent: Sep. 16, 2003

(54) LAMINATED COMMON-MODE CHOKE COIL

(75) Inventor: Hidekazu Kitamura, Sagamihara (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 39 days.

(21) Appl. No.: 10/051,043

(22) Filed: Jan. 22, 2002

(65) Prior Publication Data

US 2002/0093415 A1 Jul. 18, 2002

Related U.S. Application Data

(60) Division of application No. 09/075,197, filed on May 11, 1998, now Pat. No. 6,356,181, which is a continuation-in-part of application No. 08/826,802, filed on Mar. 25, 1997, now abandoned.

(30) Foreign Application Priority Data

Mar. 29, 1996 (JP) ..... 8-76793

(51) Int. Cl.[7] ..... H01F 7/06; H01F 5/00

(52) U.S. Cl. ..... 29/602.1; 336/200; 336/223; 29/606

(58) Field of Search ..... 336/200, 223, 336/232; 29/602.1, 606, 607

(56) References Cited

U.S. PATENT DOCUMENTS

| | | | | |
|---|---|---|---|---|
| 4,543,553 A | | 9/1985 | Mandai et al. | |
| 5,250,923 A | | 10/1993 | Ushiro et al. | |
| 5,307,045 A | | 4/1994 | Senda et al. | |
| 5,392,019 A | | 2/1995 | Ohkubo | |
| 5,552,756 A | | 9/1996 | Ushiro | |
| 5,598,135 A | * | 1/1997 | Maeda et al. | 336/200 |
| 5,781,071 A | | 7/1998 | Kusunoki | |
| 5,781,093 A | | 7/1998 | Grandmont et al. | |
| 5,850,682 A | | 12/1998 | Ushiro | |

FOREIGN PATENT DOCUMENTS

| | | | | |
|---|---|---|---|---|
| JP | 4-364709 | | 12/1992 | |
| JP | 5-6829 | | 1/1993 | |
| JP | 05055044 A | * | 3/1993 | 29/602.1 |
| JP | 5-335149 | | 12/1993 | |
| JP | 6-163270 | | 6/1994 | |
| JP | 8-203737 | | 8/1996 | |

* cited by examiner

*Primary Examiner*—Anh Mai
(74) *Attorney, Agent, or Firm*—Burns, Doane, Swecker & Mathis, LLP

(57) ABSTRACT

A laminated common-mode choke coil is disclosed in which the coupling characteristics of first and second coil electrodes are improved so as to reduce normal mode impedance. A first coil electrode and a second coil electrode are laminated across an insulating layer. The first coil electrode is formed in a spiral shape in an area from a first external electrode to a first through-hole electrode (point L). A second coil electrode is formed in a spiral shape in an area from a third external electrode to a second through--hole electrode (point K). Both coil electrodes are spirally overlapped with each other in an area from point B to point K. Three coil embodiments are also disclaosed.

9 Claims, 8 Drawing Sheets

LAMINATED COMMON-MODE CHOKE COIL

This application is a divisional of application Ser. No. 09/075,197, filed on May 11, 1998 now U.S. Pat. No. 6,356,181 which is a Continuation-In-Part Application of Ser. No. 08/826,802 filed on Mar. 25, 1997 now abandoned.

BACKGROUND OF THE INVENTION

1. Field of the Invention

The present invention relates generally to laminated common-mode choke coils and, more particularly, to a structure of a laminated common-mode choke coil in which the absolute value of normal-mode impedance can be reduced.

2. Description of the Related Art

As one type of common-mode choke coil, a laminated common-mode choke coil is available having a structure in which thin metallic patterns in the form of a coil are interposed between magnetic substrates. Two examples of this type of choke coil are disclosed in, for example, Japanese Unexamined Patent Publication No. 4-364709. The choke coil disclosed in this publication is constructed to have a plurality of layers in the following manner: a primary coil conductor and a secondary coil conductor are laminated through an insulating layer in the thickness direction according to a thin-film forming process, such as photolithography. In this laminated structure, since the insulating layer is formed according to a thin-film forming process, the thickness of the resulting layer can be reduced. This makes it possible to decrease the distance between the primary coil conductor and the secondary coil conductor opposedly facing each other across the insulating layer. Thus, a high coupling coefficient can be obtained, and a high impedance in response to common-mode noise can be achieved. As a consequence, a laminated common-mode choke coil exhibiting excellent performance in eliminating common-mode noise can be obtained.

However, the choke coil disclosed and shown in FIG. 5 in the above publication disadvantageously changes the waveform of normal-mode signals. This arises from a disturbance in magnetic balance between the primary and secondary coil conductors caused by a difference in the number of turns between the conductors.

In order to solve this problem, in the laminated common-mode choke coil disclosed and illustrated in FIG. 1 in the above publication, the configuration of the coil is adjusted to have the same number of turns between the primary and secondary coil conductors. The outer appearance of such a choke coil is shown in FIG. 5. In this choke coil generally indicated by 50, the number of turns between the primary and secondary coil conductors is made equal so that external electrodes 51 and 52 used as input/output electrodes for the primary coil conductor are diagonally disposed on the chip, and so that external electrodes 53 and 54 serving as input/output electrodes for the secondary coil conductor are also diagonally placed on the chip. With this arrangement, however, when such a coil is mounted for use, it is necessary that wiring to be connected to the primary coil conductor and to the secondary coil conductor be diagonally laid, thereby resulting in a complicated wiring pattern for mounting the coil.

To further overcome the above drawback, the following type of choke coil has been invented: a laminated common-mode choke coil having the same number of turns for the primary and secondary coil electrodes in which the external electrodes for the primary coil electrode are aligned on the same side of the chip and the external electrodes for the secondary coil electrode are also aligned on the opposing side of the chip. FIG. 6 is an exploded perspective view of an example of known laminated common-mode choke coils having the above-described construction; FIG. 7 is a plan view illustrating the pattern configuration of the primary and secondary coil electrodes; and FIG. 8 is a cross sectional view taken along line Y—Y of FIG. 6.

Referring to FIGS. 6 through 8, a laminated common-mode choke coil generally designated by 10 is constructed by laminating a plurality of insulating layers 13A, 13 and 15 between a pair of magnetic substrates 11 and 17. Formed between the insulating layers 13A and 13 is a primary coil electrode 12*a* formed of a thin metallic film. The primary coil electrode 12*a* is connected at one end to an external electrode 3*a* and at the other end to a node 22*a* between the electrode 12*a* and first through-hole electrodes 23*a* and 25*a*. Also, a secondary coil electrode 14*b* is disposed between the two insulating layers 13 and 15. The electrode 14*b* is connected at one end to an external electrode 2*b* and at the other end to a node 24*b* between the electrode 14*b* and a second through-hole electrode 25*b*.

Further, formed between the insulating layer 15 and magnetic substrate 17 are a lead electrode 16*a* for the primary coil electrode 12*a* and a lead electrode 16*b* for the secondary coil electrode 14*b*. The primary-coil lead electrode 16*a* is connected between an external electrode 4*a* and a node 26*a* between the electrode 16*a* and the first through-hole electrodes 23*a* and 25*a*, while the secondary-coil lead electrode 16*b* is connected between an external electrode 5*b* and a node 26*b* between the electrode 16*b* and the second through-hole electrode 25*b*.

In this common-mode choke coil 10, the number of turns of the primary coil electrode 12*a* and that of the secondary coil electrode 14*b* are set substantially equal to each other, and more particularly, the former is set to approximately 2 T (turns), while the latter is set to 2·1/8 T. Additionally, the external electrodes 3*a* and 4*a* for the primary coil electrode 12*a* are disposed to project from the same side of the rectangular-prism-shaped chip, and the external electrodes 2*b* and 5*b* for the secondary coil electrode 14*b* are also placed to project from the opposite side of the chip.

As described above, in the above type of choke coil, in order to keep the waveform of normal-mode signals from changing, it is important to maintain a magnetic balance between the primary and secondary coil electrodes. Accordingly, in the choke coil illustrated in FIGS. 6 through 8, the number of turns of the primary coil electrode 12*a* is set equal to that of the secondary coil electrode 14*b*.

If the coil pattern is arranged so that the number of turns of the primary coil electrode 12*a* can be equal to that of the secondary coil electrode 14*b*, as illustrated in FIG. 7, there are disadvantageously created portions in which the primary and secondary coil electrodes 12*a* and 14*b* are not overlapped in the vicinity of the through-hole electrodes 23*a* and 25*b*. Magnetic coupling force between the coil electrodes 12*a* and 14*b* is weaker in such non-overlapping portions, thereby increasing the impedance in relation to normal-mode signals.

SUMMARY OF THE INVENTION

Accordingly, it is an object of the present invention to provide a laminated common-mode choke coil that can reduce the impedance in the normal mode by improving the magnetic coupling force between a pair of coil electrodes.

In order to achieve the above object, according to the present invention, there is provided a laminated common-mode choke coil comprising: a laminated structure having a plurality of layers including a pair of magnetic substrates and an insulating layer interposed between the pair of magnetic substrates; primary (first) and secondary (second) coil electrodes disposed on the different layers of the laminated structure; first through fourth external electrodes formed at the edges of the laminated structure, the first external electrode being connected to one end of the primary coil electrode, and the third external electrode being connected to one end of the secondary coil electrode; and first and second through-hole electrodes through which the second external electrode is connected to the other end of the primary coil electrode and the fourth external electrode is connected to the other end of the secondary coil electrode, wherein said primary and secondary coil electrodes are spiral in shape, and said primary coil electrode extending from a connecting portion with said first external electrode and overlapping with said secondary coil electrode except at a position between said first and second through-hole electrodes.

According to a more specific aspect of the present invention, there is provided a laminated common-mode choke coil comprising: a pair of first and second magnetic substrates; a rectangular-prism-shaped laminated structure having first and second insulating layers laminated between the first and second magnetic substrates; a primary coil electrode formed between the first magnetic substrate and the first insulating layer, and a first external electrode connected to one end of the primary coil electrode; a first lead electrode formed between the second insulating layer and the second magnetic substrate and electrically connected at one end to the other end of the primary coil electrode; a second external electrode connected to the other end of the first lead electrode; a secondary coil electrode formed between the first and second insulating layers, and a third external electrode connected to one end of the secondary coil electrode; a second lead electrode formed between the second insulating layer and the second magnetic substrate and electrically connected at one end to the other end of secondary coil electrode; a fourth external electrode connected to the other end of the second lead electrode; first through-hole electrodes formed inside the first and second insulating layers and connecting the other end of the primary coil electrode and one end of the first lead electrode; and a second through-hole electrode formed inside the second insulating layer and connecting the other end of the secondary coil electrode and one end of the second lead electrode. The first and second external electrodes are positioned to be partially exposed from a first lateral surface of the laminated structure, while the third and fourth external electrodes are positioned to be partially exposed from a second lateral surface opposing the first lateral surface of the laminated structure. The primary coil electrode is formed in a spiral shape in an area from the first external electrode to the first through-hole electrode, while the secondary coil electrode is formed in a spiral shape in an area from the third external electrode to the second through-hole electrode. Further, the primary coil electrode is spirally configured in such a manner that it extends from the first external electrode and overlaps with the secondary coil electrode until a position where the primary coil electrode reaches the second through-hole electrode.

According to a restricted aspect of the present invention, there is provided a laminated common-mode choke coil in which the primary coil electrode may be linearly formed from a position where it passes over the second through-hole electrode to a position where the primary coil electrode reaches the first through-hole electrode.

According to another aspect of the present invention, there is provided a laminated common-mode choke coil comprising: laminated structure having a plurality of layers including a pair of magnetic substrates and a first insulating layer interposed between said pair of magnetic substrates; primary and secondary coil electrodes disposed on the different layers of said laminated structure; first through fourth external electrodes located at edge of said laminated structure, said first external electrode being connected to one end of said primary coil electrode, and said third external electrode being connected to one end of said secondary coil electrode; and first and second through-hole electrodes through which said second external electrode is connected to the other end of said primary coil electrode and said fourth external electrode is connected to the other end of said secondary coil electrode.

In the laminated common-mode choke coil constructed in accordance with the present invention, since the primary and secondary coil electrodes are spirally configured as described above, the overlapped portion between the primary and secondary coil electrodes in the vicinity of the second through-hole electrode can be increased as compared with conventional choke coils having the spiral shape shown in FIG. 7. This improves the magnetic coupling force between both the coil electrodes, thereby reducing the impedance in relation to normal-mode signals.

DESCRIPTION OF THE PREFERRED EMBODIMENT

Figure 1:
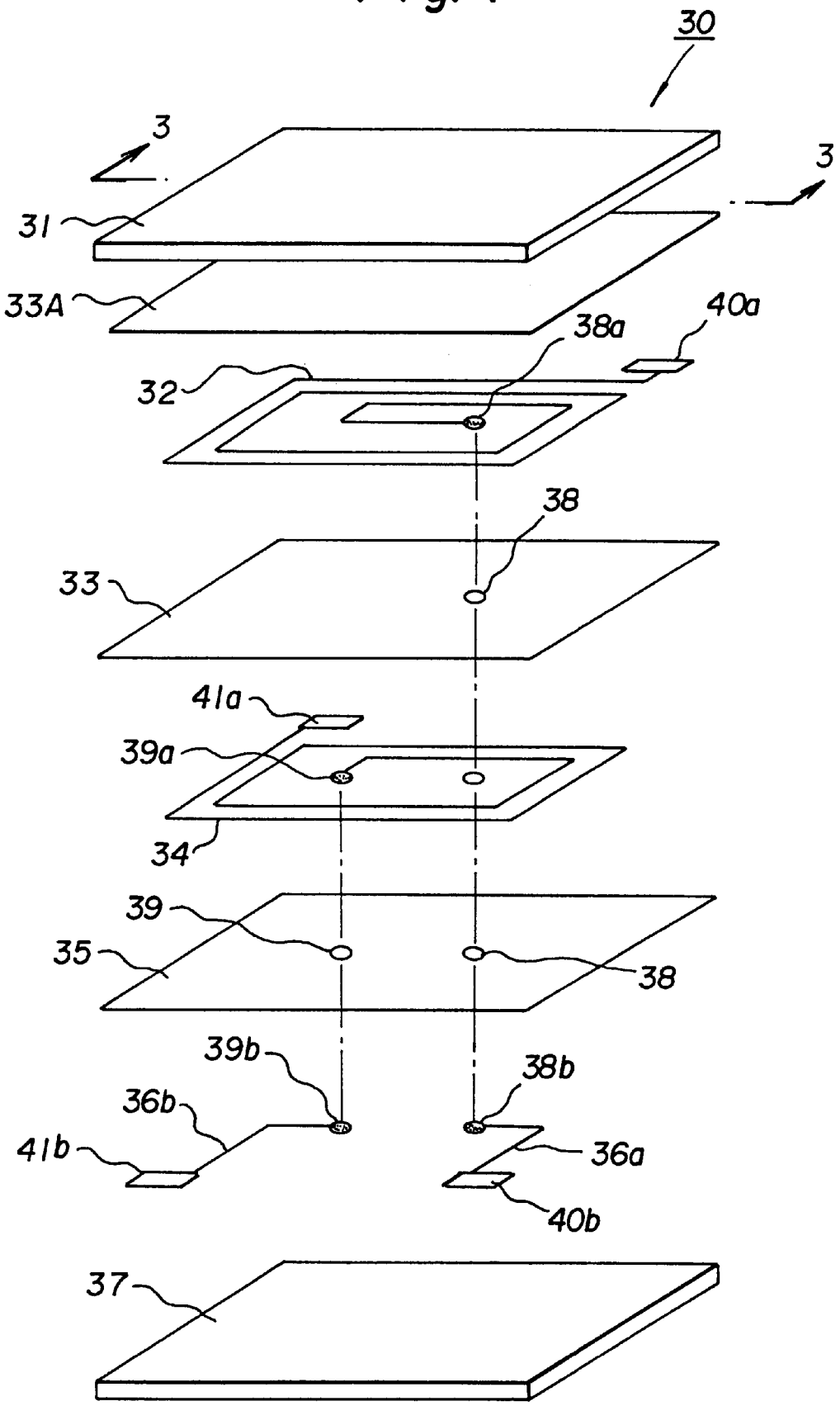
FIG. 1 is an exploded perspective view of a laminated common-mode choke coil according to an embodiment of the present invention.

The present invention will now be described in greater detail through illustration of an embodiment while referring to the drawings.

Figure 2:
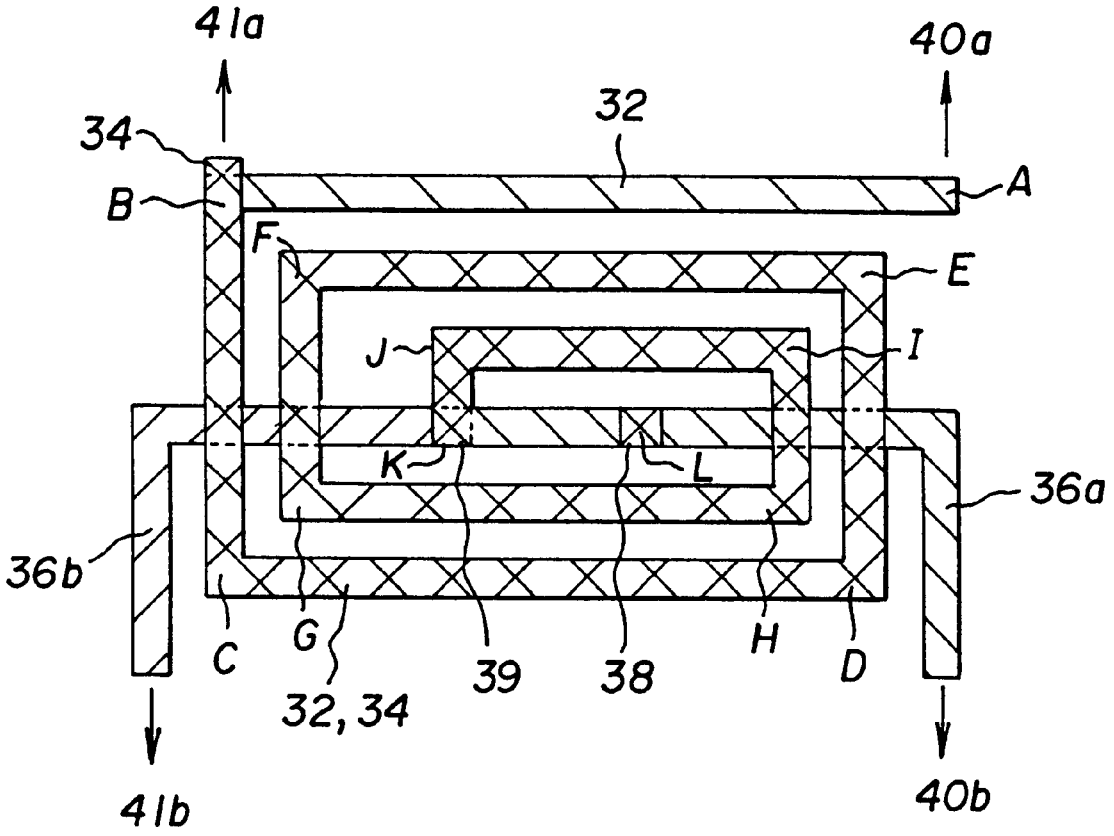
FIG. 2 is a plan view illustrating the spiral configuration of primary and secondary coil electrodes of the common-mode choke coil shown in FIG. 1.
Figure 3:
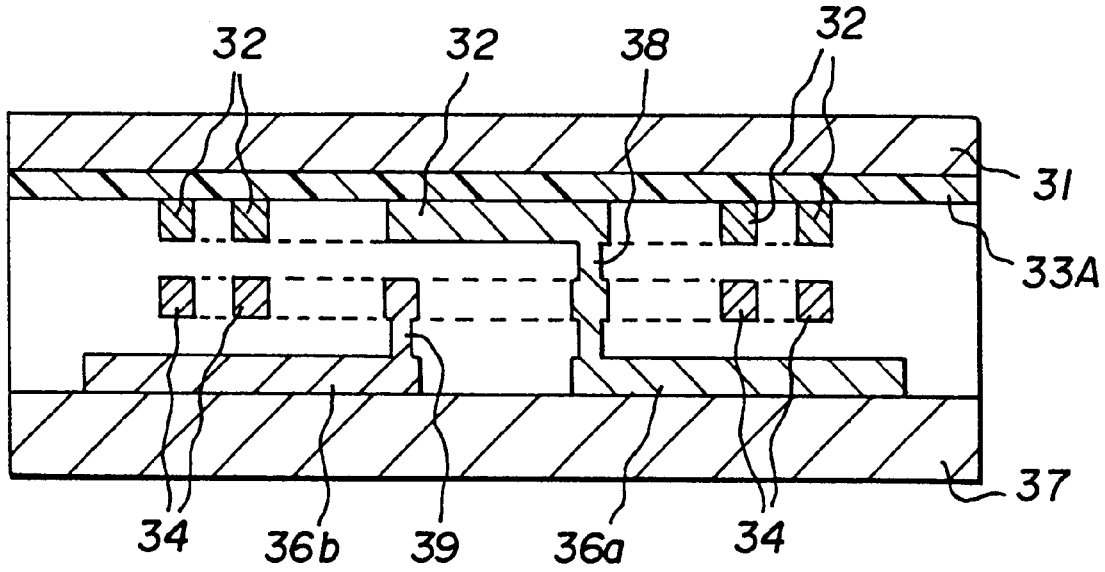
FIG. 3 is a cross sectional view taken along line X—X of FIG. 1.

Referring to FIGS. 1 through 3 illustrating an embodiment of the present invention, a laminated common-mode choke coil generally indicated by 30 comprises a laminated structure formed of a pair of magnetic substrates 31 and 37, and a plurality of insulating layers 33A, 33 and 35 laminated between the substrates 31 and 37. The magnetic substrates 31 and 37 may be made of a Ni—Zn ferrite, Mn—Zn ferrite, hexagonal ferrite, or the like, substrate produced by powder molding. The insulating layers 33 and 35 are made of thin insulating film having a 5 $\mu$m thickness, made from, for example, polyimide, while the insulating layer 33A is formed of thin insulating film having a 15 $\mu$m thickness, made from, for example, polyimide. The insulating layers may be made of materials such as resin like polyimide resin, epoxy resin, acrylic resin, circular olefin resin, Benzo Cyclo Butene resin, or glass like $SiO_2$, glass ceramics,etc. The insulating layers may be formed by techniques associated with photolithography, or printing, or the like. These techniques include spin coating, dip coating, spray coating, transfer coating, and the like.

An Ag film having a thickness of from 1 to 10 $\mu$m is deposited on a surface of an insulating layer 33A according to, e.g., a sputtering process, and is patterned in a spiral shape according to photolithography techniques, thereby forming a primary coil electrode 32. The electrode 32 is connected at one end to a first external electrode 40*a* which is patterned together with the primary coil electrode 32, and at the other end to first through-hole electrodes 38 formed within the through-holes passing through the insulating layers 33 and 35.

Also, an Ag film having a thickness of from 1 to 10 $\mu$m is deposited on the surface of the insulating layer 33 (35) according to, e.g., a sputtering process, and is patterned in a spiral shape according to photolithography techniques, thereby forming a secondary coil electrode 34. The electrode 34 is connected at one end to a third external electrode 41*a* which is patterned together with the secondary coil electrode 34, and at the other end to a second through-hole electrode 39 formed within the through-hole passing through the insulating layer 35.

Further, formed on the surface of the magnetic substrate 37 are first and second lead electrodes 36*a* and 36*b* formed of a thin Ag film pattern. The first lead electrode 36*a* is connected at one end to an end 38*b* of the first through-hole electrode 38 and at the other end to a second external electrode 40*b* for the primary coil electrode 32. The second lead electrode 36*b* is connected at one end to an end 39*b* of the second through-hole electrode 39 and at the other end to a fourth external electrode 41*b* for the secondary coil electrode 34.

As the electrode material, materials other than Ag can be used, such as Pd, Al, Au, Cu, Ti, Cr, Ni, Pt or alloys thereof.

The pair of magnetic substrates 31 and 37, the insulating layers 33A, 33 and 35, the primary and secondary coil electrodes 32 and 34, and the first and second lead electrodes 36*a* and 36*b* are bonded and laminated together using a polyimide adhesive in the order of the elements shown in FIG. 1. The laminated structure having a large number of devices is diced into chip-sized portions, thereby producing a laminated common-mode choke coil. The first and second external electrodes 40*a* and 40*b* for the primary coil electrode 32 are exposed from the edge surface of one side of the chip, while the third and fourth external electrodes 41*a* and 41*b* for the secondary coil electrode 34 are exposed from the edge surface of the other side of the chip. An external electrode may be formed by a method such as vapor deposition, sputtering, electrodeless plating, or the like.

An explanation will now be given of the spiral configuration of the primary and secondary coil electrodes 32 and 34 with reference to FIG. 2. The primary and secondary coil electrodes 32 and 34 opposedly face each other across the insulating layer 33. The primary coil electrode 32 is, as illustrated in FIG. 2, spirally formed from point A to point L through points B, C, D, E, F, G, H, I, J and K, and connected to the first through-hole electrode 38 at point L. In contrast, the secondary coil electrode 34 extends substantially from point B to point K through points C, D, E, F, G, H, I and J, and connected to the second through-hole electrode 39 at point K. The portions from point B to point K of the primary and secondary coil electrodes 32 and 34 overlap in a direction perpendicular to the plane of the drawing.

Only the primary coil electrode 32 is formed in an area from point K to point L. This area is preferably made as short as possible, as long as restrictions imposed on the process of the first and second through-hole electrodes 38 and 39 can be satisfied.

Figure 4:
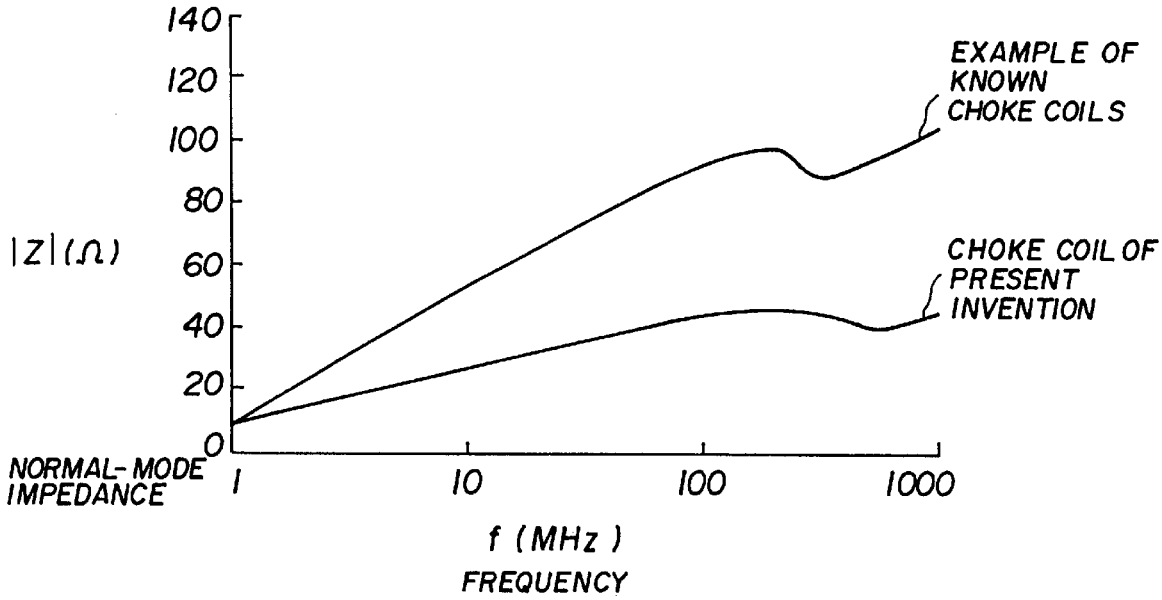
FIG. 4 is a diagram illustrating the impedance characteristics of the common-mode choke coil shown in FIG. 1.
Figure 5:
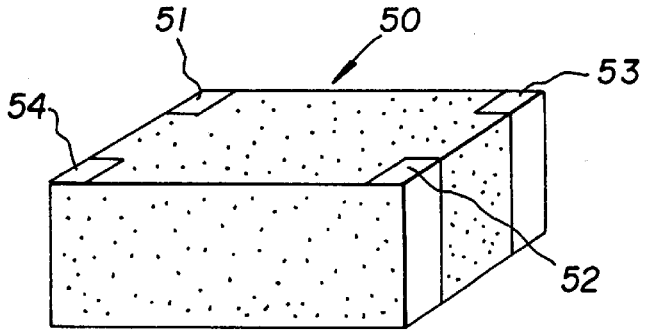
FIG. 5 is an external perspective view of an example of conventional laminated common-mode choke coils.
Figure 6:
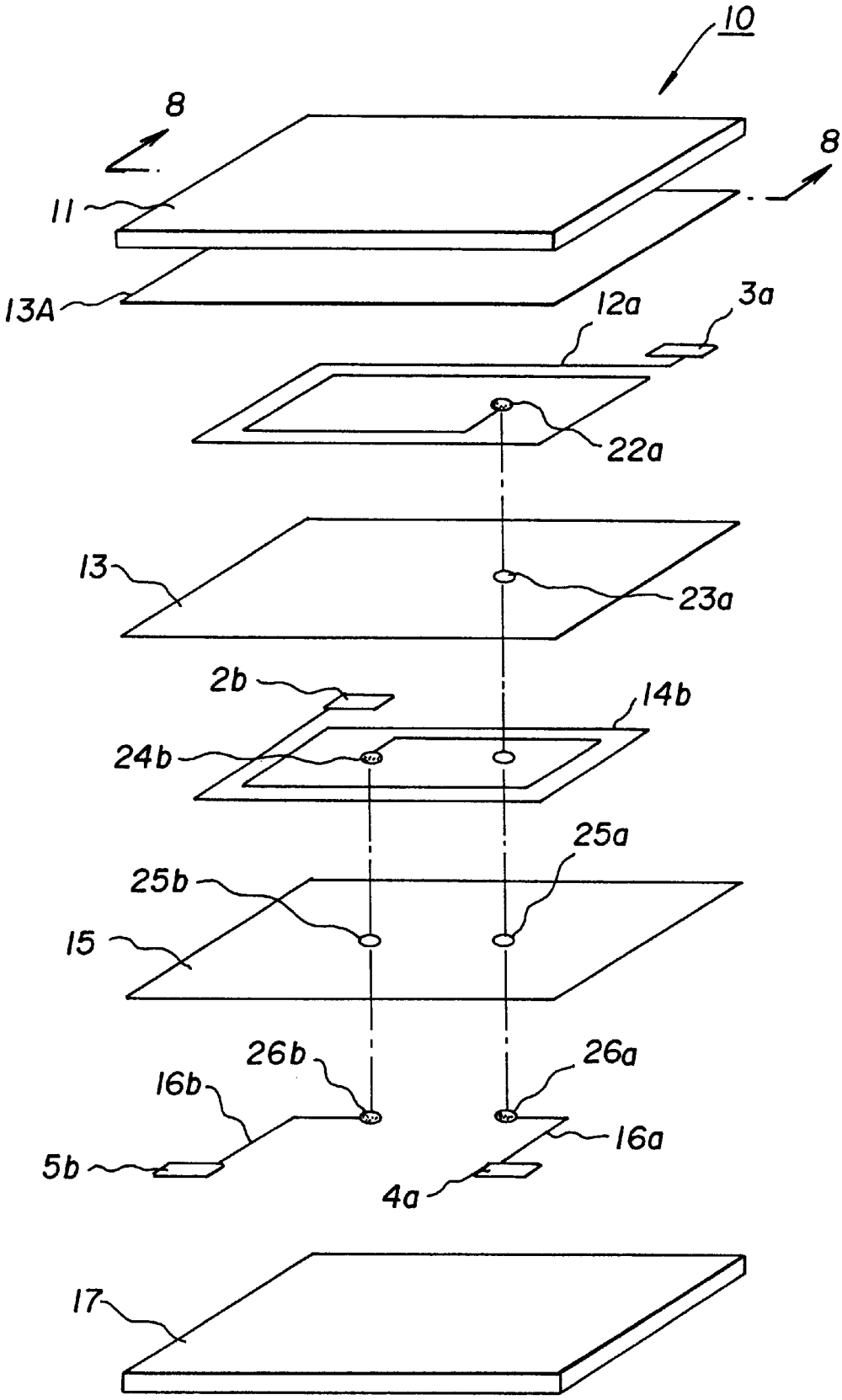
FIG. 6 is an exploded perspective view of another example of conventional laminated common-mode choke coils.
Figure 7:
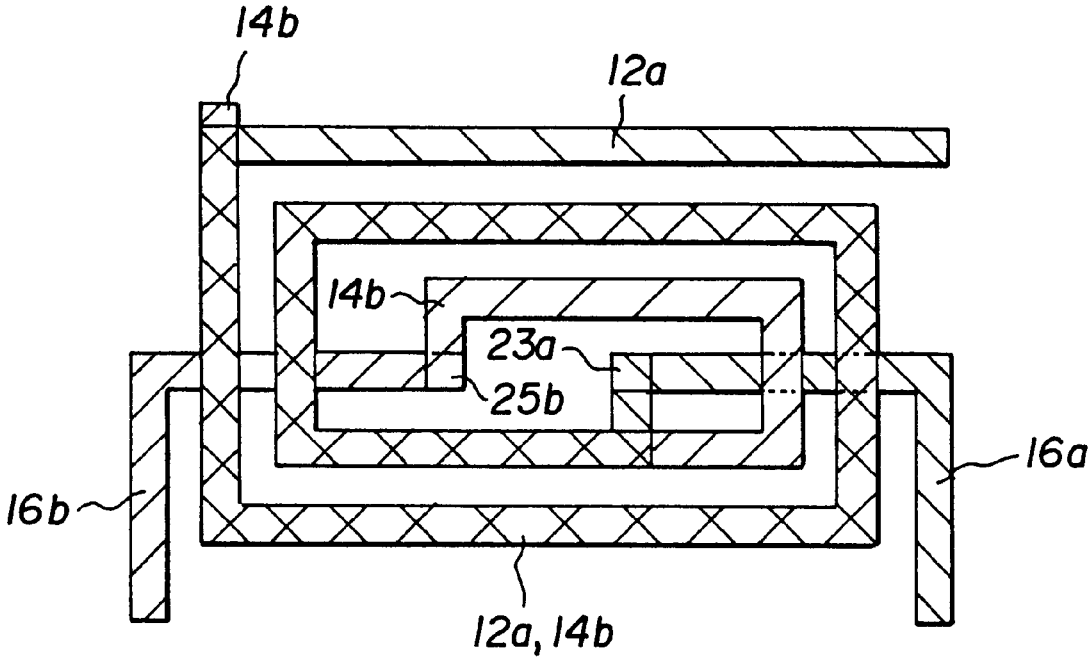
FIG. 7 is a plan view of the spiral configuration of the primary and secondary coil electrodes of the common-mode choke coil shown in FIG. 6.
Figure 8:
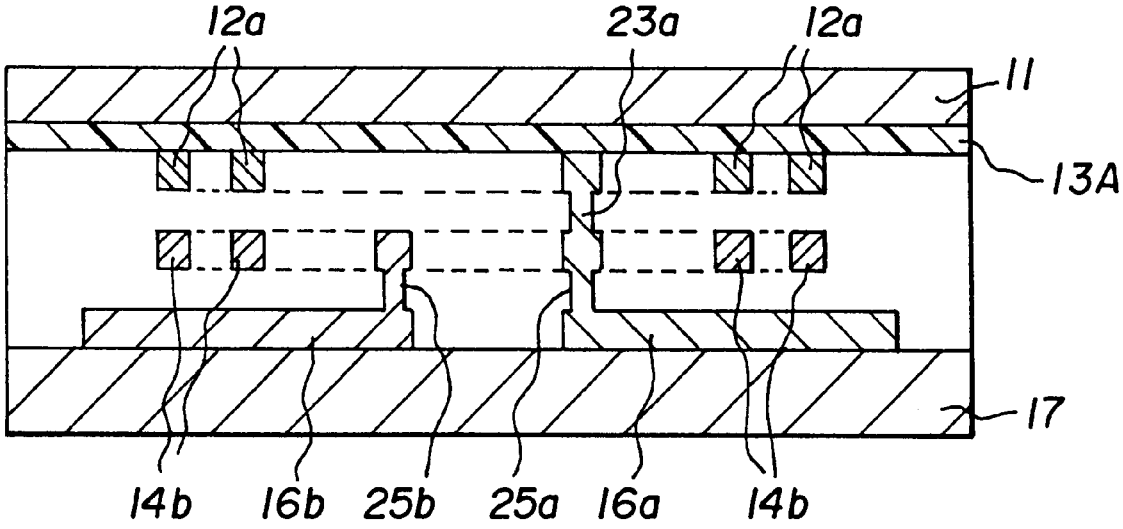
FIG. 8 is a cross sectional view taken along line Y—Y of FIG. 6.

Since the primary and secondary coil electrodes 32 and 34 are formed in the above-described spiral shape, the overlapping portion of the electrodes 32 and 34 in the vicinity of the through-hole electrodes can be increased, as compared with, for example, the conventional coil electrodes with the spiral shape shown in FIG. 7. This further makes it possible to reduce the impedance in response to normal-mode signals, which cannot be achieved in the conventional type of choke coil due to a weakened magnetic coupling force incurred where the primary and secondary coil electrodes are not overlapped. The improved impedance characteristics are shown in FIG. 4. The horizontal axis indicates the frequency f of normal-mode signals, while the vertical axis represents the absolute value $|Z|$ of the impedance in relation to the signals. FIG. 4 reveals that the laminated common-mode choke coil of the present invention achieves reduced impedance over the frequency range of all the normal-mode signals as compared with the conventional type of choke coil. This can preserve the waveform of normal-mode signals.

As will be clearly understood from the foregoing description, the laminated common-mode choke coil of the present invention offers the following advantages. The primary coil electrode is formed in a spiral shape which is generally similar to that of the secondary coil electrode, thereby increasing the overlapping portion between these coil electrodes. This can improve magnetic coupling force between both the coil electrodes and further reduce the impedance in response to normal-mode signals. It is thus possible to achieve a laminated common-mode choke coil that can substantially maintain the waveform of normal-mode signals and also exhibit excellent performance in eliminating common-mode noise.

Figure 9:
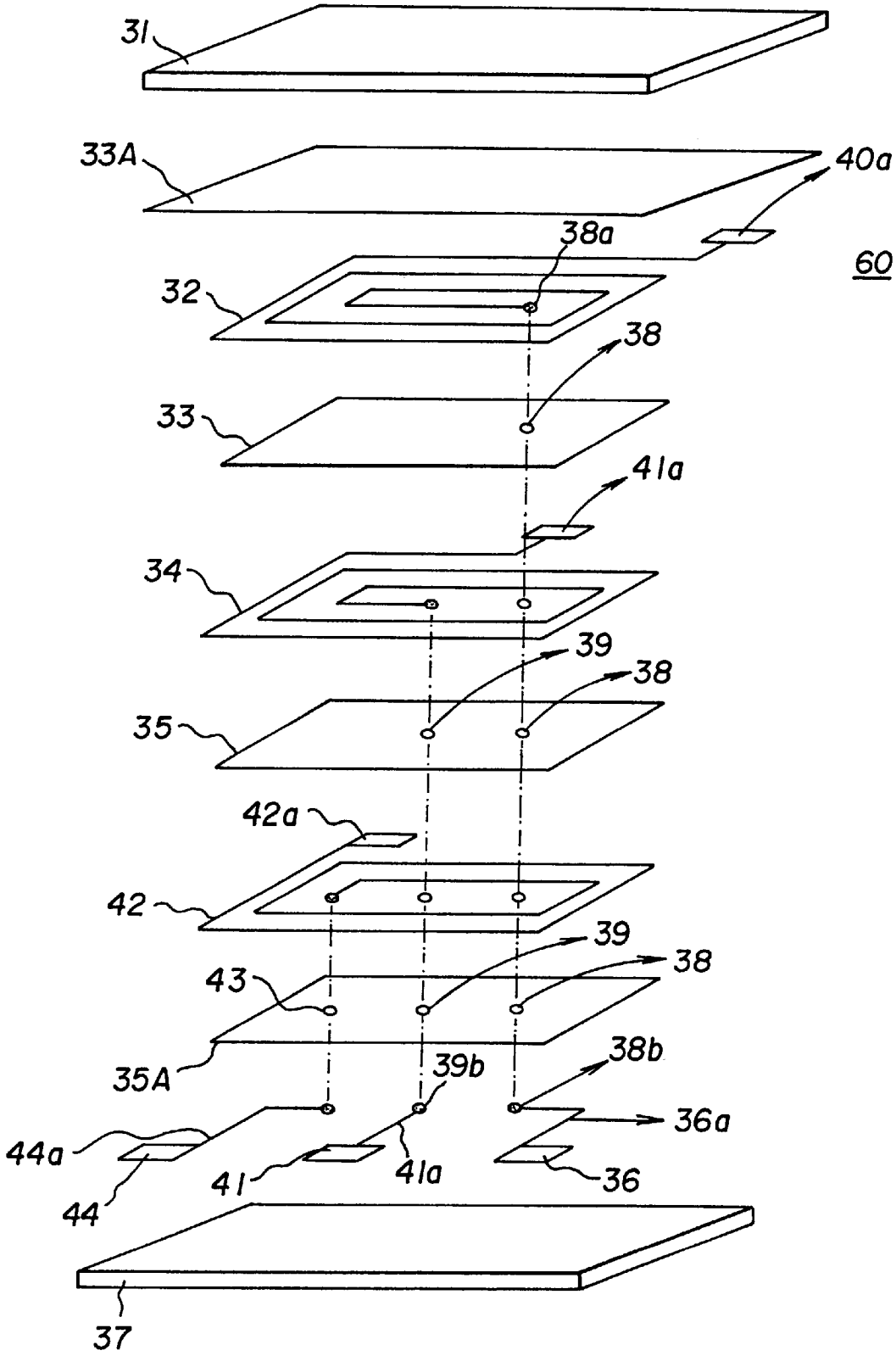
FIG. 9 is an exploded perspective view of a laminated common-mode choke coil according to another embodiment of the present invention.
Figure 10:
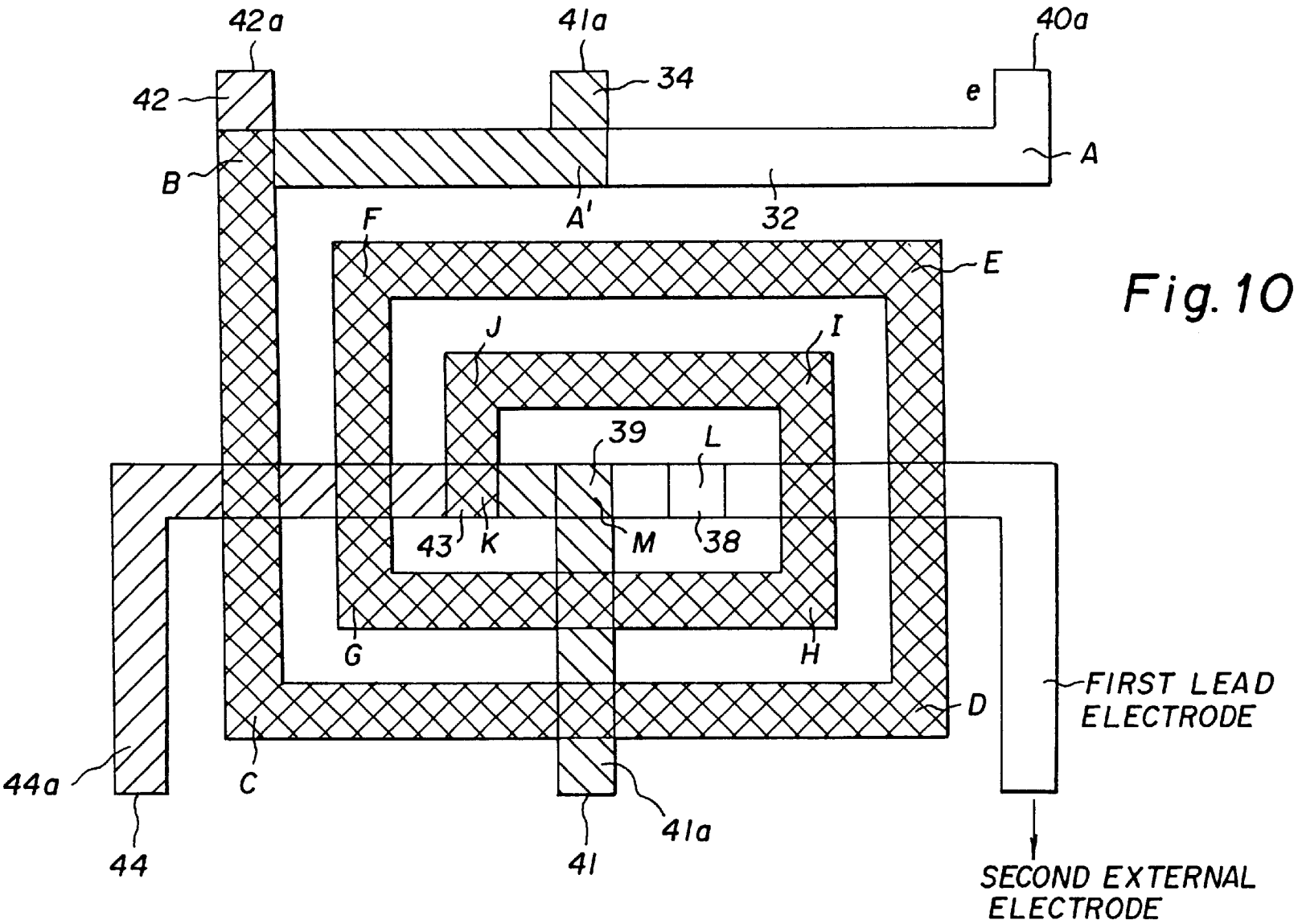
FIG. 10 is a plan view illustrating the spiral configuration of primary and secondary coil electrodes of the common-mode choke coil shown in FIG. 9.

The present invention is not limited to a common mode choke coil with two coils. As shown in FIGS. 9 and 10, according to another embodiment of the present invention, a common mode choke coil may include three or more coils.

Figure 11:
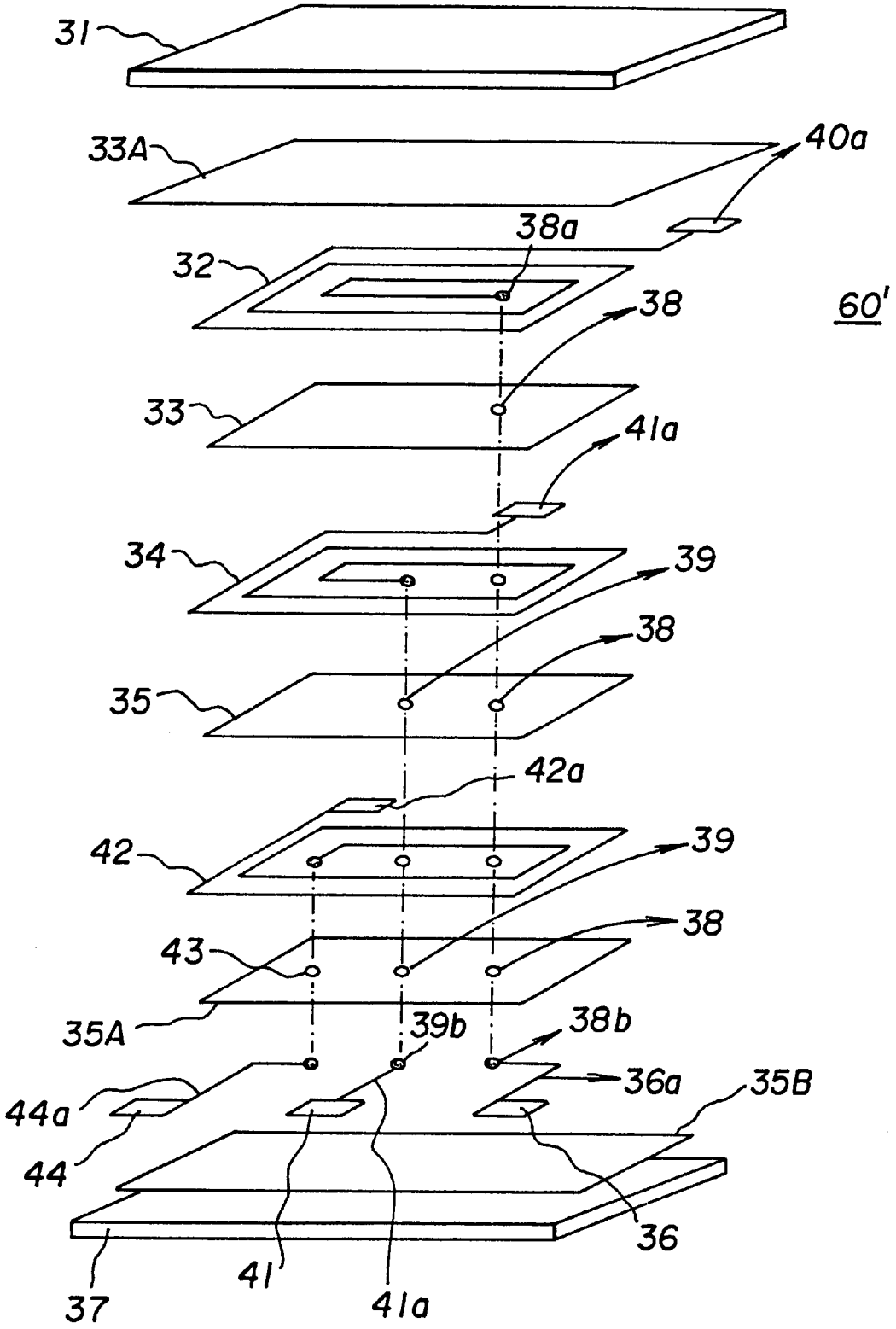
FIG. 11 is an exploded perspective view of a laminated common-mode choke coil according to another embodiment of the present invention.

Referring to FIGS. 9, 10 and 11 (where like structure is given the same reference numbers used in FIGS. 1–3) a laminated common mode choke coil generally indicated by 60, comprises a laminated structure formed of a pair of magnetic substrates 31 and 37, a plurality of insulating layers 33A, 33, 35, 35A laminated between the substrates 31 and 37.

A first coil electrode 32 formed on a surface of the first insulating layer 33 is connected to a first external electrode

40*a* at one end, and at the other end 38*a* to a first through-hole electrode 38 passing through insulating layers 33, 35 and 35A and connecting at node 38*b* to a first lead electrode 36*a* leading to a second external electrode 36. A second coil electrode 34 formed on a surface of the second insulating layer 35 is connected to a third external electrode 41*a,* which is formed at a central location on a side of the coil 60, at one end, and at the other end to a second through-hole electrode 39 passing through insulating layers 35 and 35A and connecting at node 39*b* to a second lead electrode 41*a* leading to a fourth external electrode 41. A third coil electrode 42 formed on a surface of the third insulating layer 35A is connected to a fifth external electrode 42*a* at one end, and at the other end to a third through-hole electrode 43 passing through the third insulating layer 35A to a third lead electrode 44*a* leading to a sixth external electrode 44. The materials used and techniques of forming these layers and substrates, and the techniques for laminating and dicing, are the same as described with respect to the embodiment of FIGS. 1–3.

An explanation will now be given of the spiral configuration of the first, second and third coil electrodes 32, 34 and 42 with reference to FIG. 10. The first, second and third coils 32, 34 and 42 opposingly face each other across insulating layers 33 and 35. The first coil electrode 32 is, as illustrated in FIG. 10, spirally formed from point A to point L through points B, C, D, E, F, G, H, I, J and K, and connected to the first through-hole electrode 38 at point L. The second coil electrode 34 extends substantially from point A' to point M through points B, C, D, E, F, G, H, I, J and K, and connected to the fourth external electrode 41 via second lead electrode 41*a*. The third coil electrode 42 is spirally formed from point B to point K through points C, D, E, F, G, H, I and J and connected to the third through electrode 43 through the third lead electrode 44*a* to the sixth external electrode 44. Portions from point B to point K of the first, second and third coil electrodes 32, 34 and 42 overlap in a direction perpendicular to the plane of the drawing.

Only the first coil electrode 32 is formed in the area from point M to point L. Only the first and second coil electrodes 32 and 34 are formed in the area from point K to point M. These areas are preferably made as short as possible, as long as restrictions imposed on the process of the first, second and third through-hole electrodes 38, 39 and 43 can be satisfied.

Since the first, second and third coil electrodes 32, 34 and 42 are formed in the above-described spiral shape, the overlapping portion of these electrodes 32, 34 and 42 in the vicinity of the through-hole electrodes can be increased, as compared with, for example, the conventional coil electrodes with a spiral shaped shown in FIG. 7. This further makes it possible to reduce the impedance in response to the normal-mode signals, which cannot be achieved in a conventional type choke coil due to the weakened magnetic coupling force incurred where the primary and secondary coils are not overlapping. The increase in overlapping portions between the coil electrodes improves the coupling force between the coil electrodes and further reduces the impedance in response to normal-mode signals. It is thus possible to achieve a laminated common-mode choke coil that can substantially maintain the waveform of normal-mode signals and also exhibit excellent performance in eliminating common-mode noise.

As shown in FIG. 11, another insulating layer 35B may be provided on a surface of the substrate 37. By the insulating layer 35B, isolation toward water can be improved. Materials used for the insulating layer 35B are the same as the insulating layers 33, 35 and 35A.

The present invention has been disclosed by way of exemplary embodiments to which it is not limited. The spirit and scope of the invention is to be determined by examination of the claims appended hereto.

What is claimed is:

1. A method of making a laminated common-mode choke coil, comprising the steps of:

forming a laminated structure having a plurality of layers including a pair of magnetic substrates and a first insulating layer interposed between said pair of magnetic substrates;

forming first and second spiral-shaped coil electrodes on the different layers of said laminated structure;

forming first through fourth external electrodes at the edges of said laminated structure, said first external electrode being connected to one end of said first coil electrode, and said third external electrode being connected to one end of said second coil electrode; and forming first and second through-hole electrodes through which said second external electrode is connected to the other end of said first coil electrode and said fourth external electrode is connected to the other end of said second coil electrode, wherein said first coil electrode extends from a connecting portion with said first external electrode, and overlaps said second coil electrode except at a position between said first and second through-hole electrodes.

2. A method of making a laminated common-mode choke coil according to claim 1, further comprising the steps of forming second and third insulating layers separating said first and second coils from said pair of magnetic substrates.

3. A method of making a laminated common-mode choke coil according to claim 1, wherein said step of forming first through fourth external electrodes is performed by vapor deposition.

4. A method of making a laminated common-mode choke coil according to claim 1, wherein said step of forming first through fourth external electrodes is performed by sputtering.

5. A method of making a laminated common-mode choke coil according to claim 1, wherein said step of forming first through fourth external electrodes is performed by electrodeless plating.

6. A method of making a laminated common-mode choke coil according to claim 1, wherein said step of forming a first insulating layer is performed by photolithography techniques.

7. A method of making a laminated common-mode choke coil according to claim 1, wherein said step of forming a first insulating layer is performed by printing.

8. A method of making a laminated common-mode choke coil according to claim 2, wherein said step of forming second and third insulating layers is performed by photolithography techniques.

9. A method of making a laminated common-mode choke coil according to claim 2, wherein said step of forming second and third insulating layers is performed by printing.

* * * * *